United States Patent [19]

Schambeck

[11] 4,235,055

[45] Nov. 25, 1980

[54] SYSTEM FOR ANCHORING STRESSED TENSION MEMBERS IN A CONCRETE COMPONENT

[75] Inventor: Herbert Schambeck, Frieding near Herrsching, Fed. Rep. of Germany

[73] Assignee: Dyckerhoff & Widmann A.G., Munich, Fed. Rep. of Germany

[21] Appl. No.: 961,621

[22] Filed: Nov. 17, 1978

[30] Foreign Application Priority Data

Nov. 29, 1977 [DE] Fed. Rep. of Germany ..... 2753112

[51] Int. Cl.[3] ..... E04C 3/10

[52] U.S. Cl. ..... 52/230

[58] Field of Search ..... 52/223 R, 223 L, 224, 52/225, 230, 414, 231; 404/40, 71, 100

[56] References Cited

U.S. PATENT DOCUMENTS

| | | | |
|---|---|---|---|
| 3,167,882 | 2/1965 | Abbott | 52/230 |
| 3,967,421 | 7/1976 | Dufossez | 52/223 L |

FOREIGN PATENT DOCUMENTS

| | | | |
|---|---|---|---|
| 225759 | 6/1957 | Australia | 52/230 |
| 380347 | 9/1964 | Switzerland | 52/223 L |
| 455218 | 4/1968 | Switzerland | 52/230 |
| 541437 | 11/1941 | United Kingdom | 52/230 |

*Primary Examiner*—James L. Ridgill, Jr.

*Attorney, Agent, or Firm*—Toren, McGeady and Stanger

[57] ABSTRACT

A stressed tension member includes tension elements positioned in a tubular sheathing member extending through and encased in a structural concrete component. The tension member also includes grout which along with the tension elements completely fills the transverse cross-section of the sheathing member. The tension member is anchored to the concrete components. If necessary, by releasing the anchorage, the tension member can be removed from the concrete component and replaced by another tension member, since the member is separated from engagement with the concrete component by the sheathing member.

8 Claims, 6 Drawing Figures

FIG. 2
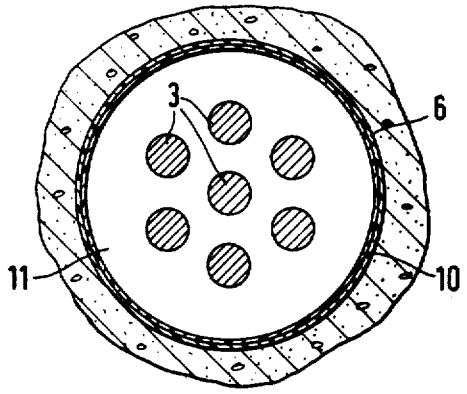
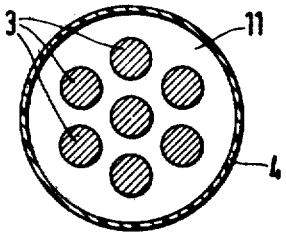
FIG. 3
FIG. 5
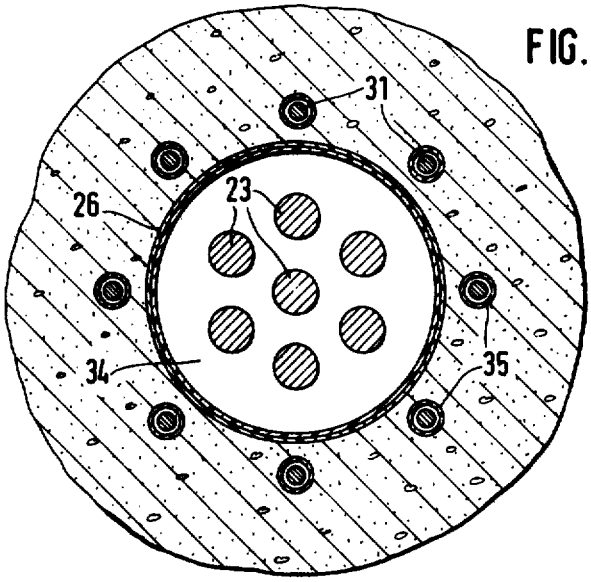

SYSTEM FOR ANCHORING STRESSED TENSION MEMBERS IN A CONCRETE COMPONENT

SUMMARY OF THE INVENTION

The present invention is directed to a system for anchoring stressed tension members in structural concrete components used for supporting heavy loads, for example, as a diagonal member in a stayed girder bridge. The tension member consists of a plurality of tension elements, such as wires, strands or the like, jointly arranged in a sheathing member and enclosed within the member by grout which is placed after the tension members are stressed. The combination of the grout and the tension elements completely fills the cross-sectional area within the sheathing member.

In a known anchoring system of this type, the sheathing member extends into the structural concrete component and consists, at least at the point where it enters the concrete component, of a metal casing which, in addition to the tension elements, is bonded to the concrete component, note German Patent 21 14 863. As a result of this design, the introduction of dead loads on one hand and of variable loads, such as live loads, on the other hand, into the concrete structure is separated and, accordingly, the vibration strength of the tension member is improved.

In concrete structures and particularly prestressed concrete structures, for corrosion protection and also for safety against rupture, a bond is provided between the tension members and the concrete structure. The provision of such a bonding action is used in known anchoring systems for tension members. Recently, however, it has been necessry to provide the possibility of replacement of diagonal members, for example in stayed girder bridges, in the event they are damaged.

Therefore, the primary object of the present invention is to provide a system for anchoring tension members where the tension member can be replaced in a structural concrete component.

In accordance with the present invention, the tension member extending through the concrete component is not bonded to the component, rather the tension member is arranged within the concrete component so that it can be removed after its anchorage to the component has been released.

Due to the manner in which the tension member is formed in the concrete component, the mortar or grout enclosing the tension elements forms a plug which is not bonded to the concrete component. While the tension member including the grout is fixed relative to the concrete component by anchoring members, the tension member can be removed from the component after the tensioning load is released and the anchoring members detached. Another tension member can be inserted into the concrete component by reversing the steps followed in the removal process.

The portion of the tension member located within the concrete component can be enclosed in a tubular sheathing member which prevents any bonding action with the concrete component. The sheathing member can be formed of a pair of sheathing tubes one within the other with the inner sheathing tube longitudinally movable relative to the outer sheathing tube which is encased within the concrete component. The sheathing tube or tubes can be encased in the concrete of the component before the tension member is placed in position.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 2 is a transverse cross-sectional view taken along line II—II in FIG. 1;

FIG. 3 is a transverse cross-sectional view taken along the line III—III in FIG. 1;

FIG. 5 is a transverse cross-sectional view taken along the line V—V in FIG. 4.

DETAILED DESCRIPTION OF THE INVENTION

Figure 1:
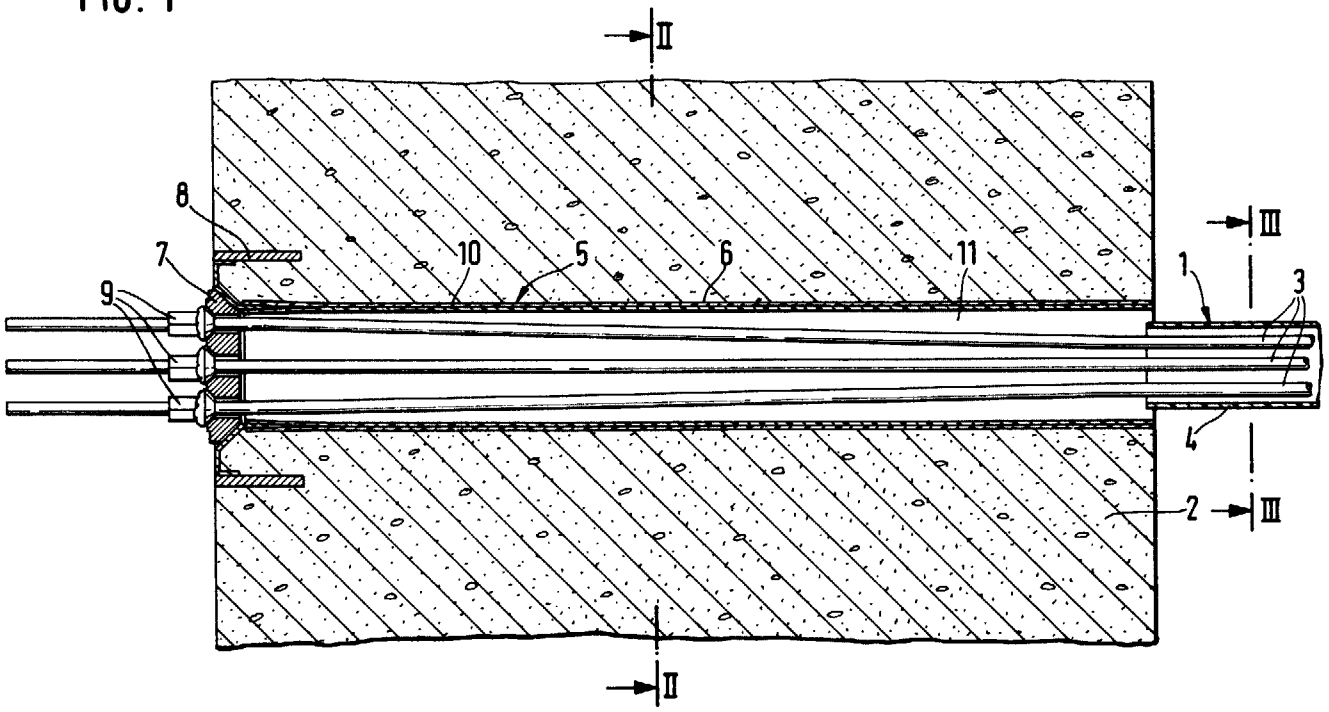
FIG. 1 is a longitudinal sectional view illustrating one embodiment of an anchoring system incorporating the present invention.

In FIG. 1 a concrete component 2 is shown having a first end surface along the right-hand side of the component and a second end surface along the left-hand side. A tension member 1 extends through the concrete component 2 from the first end surface to the second end surface and projects outwardly from both of these surfaces. The tension member consists of a plurality of separate, laterally spaced tension elements 3, such as bars, wires or strands of steel, positioned within a tubular sheathing 4. The arrangement of the tension elements 3 within the sheathing 4 can be seen in FIG. 3. The tubular sheathing 4 extends outwardly from the first end surface enclosing the tension elements 3 and may be formed of a plastics material, for example, polyethylene, or steel plate. As shown in FIG. 3, one tension element 3 is centered within the tubular sheathing with the remaining elements disposed in a concentric circle about the center element.

As shown in FIG. 1 the tubular sheathing 4 terminates at the first end surface of the concrete component 2. Within the concrete component 2, the tension elements extend through a duct 5 formed by a sheathing tube 6 made of a plastics material or the like and this tube is encased in the concrete forming the component 2. At the second end surface of the concrete component 2, the individual tension elements 3 are secured in a cylindrical block 7 which bears against an anchoring body 8 encased within the concrete of the component 2. In the illustrated embodiment, the tension elements 3 are hot-rolled steel bars. Each of the steel bars has a partial thread formed by ribs arranged in a helix and, as a result, the elements 3 can be fixed relative to the cylindrical block 7 by means of nuts 9. In the embodiment displayed in FIG. 1, an inner sheathing tube 10 is located within the outer sheathing tube 6 in contact with and longitudinally movable relative to the outer tube 6.

After the tension elements 3 have been secured to the cylindrical block 7 by the anchoring nuts 9, they are tensioned. To tension the elements either a heavy press can be used for tensioning all of the elements 3 in a member 1 at the one time, or individual jacks can be used when the elements are anchored in the cylindrical block 7 spaced by the distance between the individual jacks. After the tensioning operation has been completed, the space within the inner sheathing tube 10 about the individual tension elements 3 and also within the sheathing 4 is filled with a cement grout 11.

If, during the use of the concrete component 2 in a stayed girder bridge, it should develop that the tension member is damaged, it is possible to remove the entire tension member out of the duct 5 opposite to the tensioning direction by removing the load on the tension member 1 and detaching the anchoring nut 9 and the cylindrical block 7. In the removal operation, inner sheathing tube 10 slides relative to the outer sheathing tube 6 encased within and secured by the concrete component. When a single smooth sheathing tube forms the duct 5, the smooth sheathing tube prevents any bonding of the fresh concrete to the grout 11, accordingly, this arrangement is sufficient to facilitate the withdrawal of the tension member. It is also possible to prevent the bonding action between the concrete and the tension member in other ways for facilitating the removal of the tension member.

Figure 4:
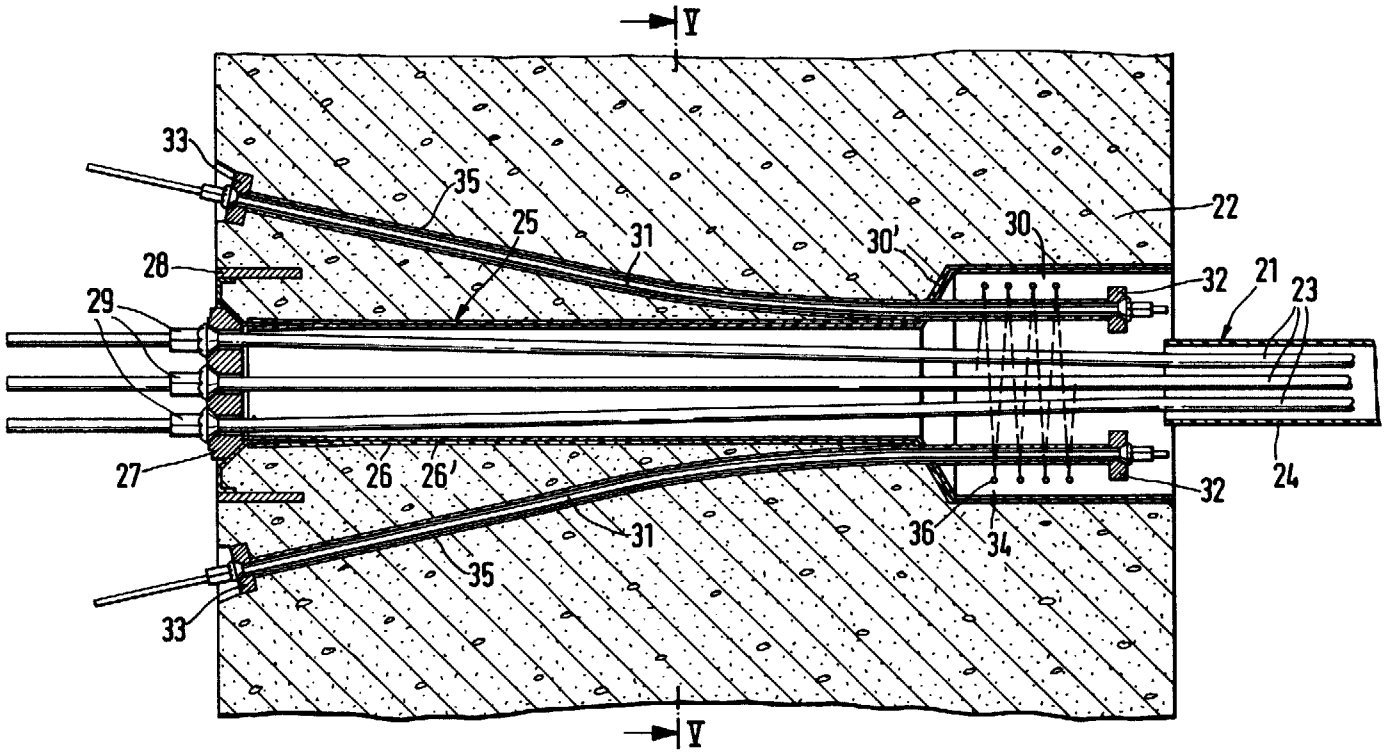
FIG. 4 is a longitudinal cross-sectional view similar to FIG. 1 illustrating another embodiment of the anchoring system.

Another embodiment of the invention is illustrated in FIGS. 4 and 5. In this embodiment a tension member 21 including a number of individual tension elements 23 extends through a sheathing member 24 to the right-hand or first end surface of the concrete component 22. The tension elements 23 extend through the concrete component 22 within a duct 25 formed by an outer sheathing tube 26 and an inner sheathing tube 26'. At the left-hand end or second end surface of the concrete component 22, the tension elements 23 are secured in a cylindrical block 27 by anchoring nuts 29 and the cylindrical block bears against an anchoring body 28 encased within the concrete component.

Duct 25 formed by the sheathing tubes 26, 26' has a radially widened portion 30 extending inwardly from the first end surface. Widened portion 30 includes a transition support surface 30' extending radially inwardly from the outside diameter of the widened portion to the diameter of the sheathing tubes 26, 26'. Additional tension elements 31 are secured at one end in anchoring bodies 32 and the tension elements 31 are located radially outwardly from the tension elements 23. Adjacent the anchoring bodies 32, the tension members 31 extend parallel to the tension elements 23 and pass through the transition support surface 30', and then extend obliquely outwardly relative to the axial direction of the duct 25 and are secured at the second end surface of the concrete component in anchoring bodies 33. These additional tension elements 31 are tensioned only after the tension member 21 has been tensioned and the grout 34 injected into the duct 25 has hardened. Accordingly, this arrangement of the tension elements 31 has the effect that subsequently occurring vibration loads due to live loads are maintained separate from the actual anchorage of the tension member 21.

Spiral shaped reinforcing 36 is located within the widened portion 30, wound around the tension members 31. The reinforcing is wound around a central axis extending generally parallel to the axis of the duct 25.

Tension elements 31 are exchangeable, they extend through sheathing tubes 35 and, for corrosion protection, are enclosed within the tubes by a suitable grout or the like.

To replace the tension member 21, initially the anchoring bodies 33 of the tension elements 31 must be detached. Subsequently, after the individual tension elements 23 are unloaded, the anchoring nuts are removed and the tension member 21 can be pulled out of the duct 25 together with the tension elements 31.

Figure 6:
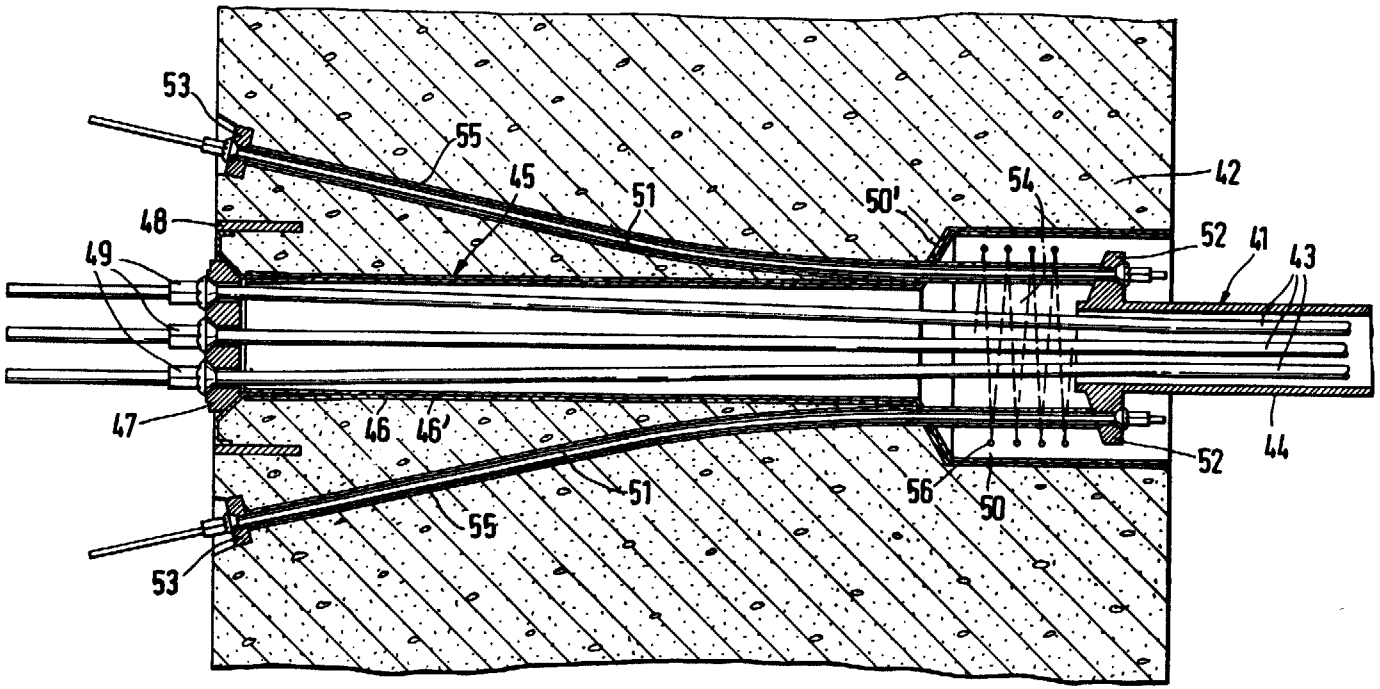
FIG. 6 is a longitudinal cross-sectional view similar to FIGS. 1 and 4 illustrating still another embodiment of the anchoring system.

In the embodiment exhibited in FIG. 6, a tension member 41 includes a plurality of individual tension elements 43 located within a sheathing tube 44. The tension member 41 extends through a concrete component 42 and the component has a first end surface and a second end surface as in the other described embodiments. At least in the region where the sheathing tube 44 enters the first end surface of the concrete component 42, it consists of a metal jacket, for example, a steel tube, which is capable of absorbing through the injected material, the forces from the individual tension elements 43 and of transmitting such forces directly into the concrete component 42. Unlike the sheathing member 4 in FIG. 1 and the sheathing member 24 in FIG. 4, the sheathing tube 44 extends inwardly into the duct 45 in the concrete component 42 so that its left-hand end as viewed in FIG. 6 extends inwardly through the first end surface of the component.

The individual tension elements 43 are guided through the concrete component 42 within the duct 45 which is formed by an outer sheathing tube 46 and an inner sheathing tube 46'. At the second end surface of the concrete component 42, the elements 43 are secured in a cylindrical block 47 by anchoring nuts 49 and the cylindrical block bears against an anchoring body 48 encased within the concrete component.

At its end adjacent the first end surface of the concrete component 42, the duct formed by the sheathing tubes 46, 46' is radially widened affording a widened or expanded region 50. Additional tension members 51 are anchored in the expanded region 50 to a metal ring 52 formed on the inner end of the sheathing tube 44. From the location within the expanded portion 50 of the duct 45, the tension elements 51 extend in generally parallel relation with the axis of the duct 45 through the transition portion of the expanded region and then obliquely outwardly relative to the axis of the duct to the second end surface of the component where they are secured in the anchoring bodies 53.

The additional tension elements 51 are tensioned only after the tension member 41 has been tensioned and the grout injected into the duct 45 has hardened and, accordingly, any vibration loads which occur as a result of live loads, are tramsitted through the grout 54 into the metal casing 44 and are maintained separate from the anchorage of the tension member 41 and are absorbed through the tension elements 51. The tension elements 51 are replaceable as in the embodiment described above. To effect such replacement, the tension elements 51 are located within sheathing tubes 55 and within the tubes, for corrosion protection, are enclosed by a suitable grout or the like.

The spiral shaped reinforcing 56 is located within the widened portion 50, wound around the tension member 51. The reinforcing is wound around a control axis extending generally parallel to the axis of the duct 45.

The sheathing tubes forming the ducts through the concrete component can be formed with a slightly conically widening configuration in the direction opposite to the tensioning direction.

While specific embodiments of the invention have been shown and described in detail to illustrate the application of the inventive principles, it will be understood that the invention may be embodied otherwise without departing from such principles.

What is claimed is:

1. System for anchoring stressed tension members in a concrete structure for supporting high loads, such as a diagonal member in a stayed girder bridge, comprising a structural concrete component having a first end surface and an oppositely facing second end surface spaced from said first end surface, sheathing means extending through said concrete component from the first end surface to the second end surface for forming a tubular passageway therethrough, a plurality of first tension elements extending through the tubular passageway formed by said sheathing means from the first end surface to the second end surface of said concrete component, grout enclosing said first tension elements and in combination with said first tension elements completely filling the transverse cross-section of the tubular passageway formed by said sheathing means between the first and second end surfaces of said concrete component, first means for anchoring said first tension elements within said sheathing means relative to said concrete component, wherein the improvement comprises that said sheathing means are disposed in surface contact with and are encased by said concrete component and separate said first tension elements and grout from engagement with said concrete component and at least said first tension elements and grout being removable from said sheathing means after said first means for anchoring said first tension elements are released, said sheathing means includes a sheathing tube extending through said concrete component with the outer surface of said sheathing tube disposed and encased in contacting engagement with said concrete component and laterally enclosing said first tension elements and grout, said anchoring means for said first tension elements are located at the second end surface of said concrete component, said sheathing tube has an axially extending section extending from the first end surface of said concrete component for a portion of the axial length of said sheathing tube, said axially extending section has a larger diameter than and extends radially outwardly from the remainder of said sheathing tube and includes an annular support section forming a transition from the larger diameter axially extending section to the remainder of said sheathing tube, second tension elements located radially outwardly from and around said first tension elements within said larger diameter axially extending section of said sheathing tube, second means for anchoring said section tension elements located within the larger diameter section of said sheathing tube adjacent the first end surface of said concrete component, said second tension elements being substantially parallel with said first tension elements within said larger diameter axially extending section, said second tension elements extending from said larger diameter axially extending section through said transition support section into said concrete component, third means for anchoring said second tension elements located at the second end surface of said concrete component spaced outwardly from said first means for anchoring said first tension members and outwardly from said sheathing means, and means located with said concrete component between said transition support section and the second end surface of said concrete component for maintaining said second tension elements out of contact with said concrete component so that by releasing said third anchoring means said additional tension elements can be removed from said concrete component.

2. System, as set forth in claim 1, wherein said second tension elements within said concrete component between said transition support section and the second end surface diverge outwardly away from said first tension elements so that said second tension elements extend obliquely of said first tension elements.

3. System, as set forth in claim 1, wherein said sheathing tube includes an outer sheathing tube in contacting and encased engagement with said concrete component and an inner sheathing tube within said outer sheathing tube and laterally enclosing said tension elements and grout, and said inner sheathing tube being axially movably displaceable relative to said outer sheathing tube so that said inner sheathing tube along with said tension elements and grout can be removed from said concrete component and replaced.

4. System, as set forth in claim 1, wherein said sheathing tube is encased in the concrete forming said concrete component prior to the placement of said tension elements and said sheathing tube.

5. System, as set forth in claim 1, wherein said sheathing tube has a slight conical shape widening in the direction opposite to the direction in which the tension elements are tensioned.

6. System, as set forth in claim 1, wherein a spiral shaped reinforcing having a central axis extending in generally parallel relation with the axis of said sheathing tube laterally encircles said first tension elements and said second tension elements and is located within said larger diameter axially extending section of said sheathing tube.

7. System, as set forth in claim 1, wherein said first tension elements extend axially outwardly from the first end surface of said concrete component away from said concrete component, said sheathing means includes a metal casing laterally enclosing said first tension elements extending outwardly from the first end surface with said metal casing located within and spaced radially inwardly from said larger diameter axially extending section and projecting outwardly from said larger diameter axially extending section in the direction outwardly from the first end surface, said metal casing having a first end located within said larger diameter axially extending section and a second end spaced outwardly from the first end surface, and said second anchoring means comprises an anchoring ring secured to and laterally enclosing the first end of said metal casing and said second tension elements secured to said anchoring ring.

8. System, as set forth in claim 7, including means for releasably securing said second tension elements to said anchoring ring.

* * * * *